United States Patent [19]

Tong

[11] 4,135,326

[45] Jan. 23, 1979

[54] AQUATIC FIGURE TOY

[75] Inventor: Duncan Tong, Hong Kong, Hong Kong

[73] Assignee: Playart Limited, Hong Kong, Hong Kong

[21] Appl. No.: 757,252

[22] Filed: Jan. 6, 1977

[30] Foreign Application Priority Data

Nov. 18, 1976 [GB] United Kingdom ..... 48155/76

[51] Int. Cl.[2] ..... A63H 23/10

[52] U.S. Cl. ..... 46/92; 46/94; 46/264

[58] Field of Search ..... 46/92, 91, 95, 94

[56] References Cited

U.S. PATENT DOCUMENTS

| | | | |
|---|---|---|---|
| 2,534,639 | 12/1950 | Twist | 46/91 X |
| 2,703,469 | 3/1955 | Raizen | 46/92 |
| 3,153,879 | 10/1964 | Lucas | 46/92 |
| 3,332,165 | 7/1967 | Losonczy et al. | 46/92 |
| 3,628,286 | 12/1971 | Mashahiro | 46/247 |

*Primary Examiner*—Russell R. Kinsey
*Assistant Examiner*—Mickey Yu
*Attorney, Agent, or Firm*—Townsend and Townsend

[57] ABSTRACT

A floating toy comprising a body simulating a human swimmer or diver, and a battery operated motor housed in a water-tight compartment and connected to the leg(s) and/or arms of the body by a linkage the linkage being such as to cause the legs and/or arms of the said body to oscillate to and fro relative to the body in simulation of the kicking movement of the legs of a swimmer, to propel the toy through water, on which the toy is floating.

3 Claims, 1 Drawing Figure

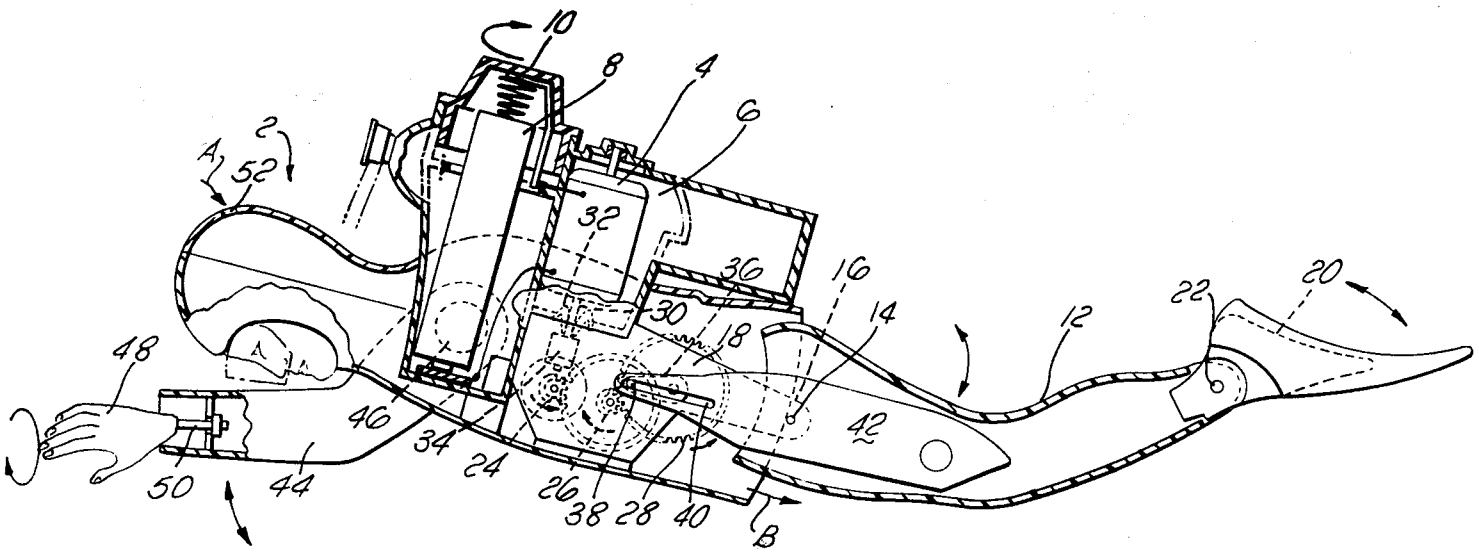
20
22
12
14
16
42
B
6
36
18
4
30
40
28
8
32
38
26
10
24
34
46
2
52
A
44
50
48

AQUATIC FIGURE TOY

This invention relates to toys and is particularly concerned with a toy simulating a swimmer or diver.

A floating toy in accordance with this invention comprises a body simulating a human swimmer or diver, and a battery operated motor housed in a watertight compartment and arranged to drive the leg(s) and/or arm(s) of the body the arrangement being such that when the body is placed in water it floats and is moved through the water, on operation of the motor, by the movement of the arm(s) and/or leg(s).

Preferably both legs are driven by the motor through a linkage designed to cause the legs to oscillate to and fro relative to the body so that when the body is located approximately horizontal in the water the movement of the legs simulates the kicking movement of the legs of a swimmer.

The movement of each leg may be achieved by a drive comprising a crank driven, through gearing, by the motor and a lever having a slot receiving a pin connected to the crank and extending down within the top portion of the hollow leg.

The arms and/or hands can preferably be pivotally moved relatively to the remainder of the body so that the attitude of the diver/swimmer in the water can be adjusted. The feet of the figure are also preferably pivotted to the ends of the respective legs.

The body of the swimmer or diver may be provided with an appropriate water inlet and outlet.

The invention will now be further described by way of example with reference to the accompanying drawing which is a diagrammatic part sectional elevation of one embodiment of toy in accordance with this invention.

The toy comprises a body generally indicated at 2, simulating a human diver which is intended to float substantially horizontally with the face of the diver facing downwardly beneath the surface of the water.

A motor 4 is housed in a watertight compartment 6 within the body and is powered by a battery 8 also located in the compartment 6, the battery being connected to the motor through a rotary on-off switch 10 which is operable from outside the body and which in use will normally be located above water level.

Legs 12 are each pivotally mounted at 14 to an extension 16 of an internal wall 18 constituting a gear box. Feet 20 are pivotally connected at 22 to the outer end of the legs and have a small degree of freedom, they are each appropriately shaped to simulate a flipper carried by the foot.

The legs are driven by the motor through a drive comprising three gear wheels 24, 26, 28 mounted in the gear box 18, the gear 24 being driven by a shaft 30 of the motor which extends through a waterproof gland 32 in the wall of the watertight housing and carries a bevel 34 engaging the gear 24.

The spindle of the last gear 28 of the chain carries, for each leg, a crank lever 36, the pin 38 of which engages in a slot 40 in one end of a drive member 42 which is located in the hollow top of each leg respectively and which is also pivotted to the pivot 14.

It will be appreciated that when the motor is running the rotation of the cranks 36 cause the inner ends of the members 42 to oscillate up and down and due to the shape of that portion of the members 42 which engage freely in the legs, the legs are caused also to oscillate up and down.

The cranks 36 are offset one from the other on their spindle so that when one leg 12 is positioned upwardly the other extends downwardly so that the legs move up and down out of alignment to simulate the movement of the legs of a swimmer and to urge the toy through the water.

The two arms 44 of the diver are pivotally mounted on the body as indicated at 46 and the hands 48 are each provided with a spindle 50 rotatably mounted in the ends of each arm respectively. It will be appreciated that the arms 12 can be positioned at any desired inclination to the body and the hands 16 rotated to any desired position relative to the arms. The setting of the arms and hands determines the attitude of the swimmer in the water as it is urged forward by the motor.

During its forward movement the body is buoyed up by the flotation effect of the sealed chamber 6, water entering the body through the inlet 52 in the diver's helmet and energizing around the legs of the diver as illustrated by the arrow B.

I claim:

1. A floatable toy simulating a human swimmer for placement in and propulsion through water comprising: a hollow body including a head portion and a trunk portion and defining therein an interior chamber, the body including a water inlet opening adjacent the head portion, the body being further open at an end thereof remote from the head portion to define a water outlet; a watertight housing secured to the body and defining within itself a watertight compartment; motor means disposed within the compartment and including a drive shaft extending through an aperture in the housing into the chamber; arms pivotally attached to the trunk portion proximate the head portion; hollow legs having a first open end extending into the outlet defined by the trunk portion and means for pivotally attaching the legs to the trunk portion so that the legs can oscillate about a pivot axis; a crank arm secured to each leg and protruding through the open end thereof into the chamber, the crank arm defining an elongated slot disposed within the chamber; means mounting a crank shaft for rotation about an axis parallel to the pivot axis of the leg, the crank shaft mounting means being disposed within the chamber and positioning the crank shaft so that it engages the slot; and gear means operatively coupled to the drive shaft and the crank shaft mounting means for rotating the latter; whereby the energization of the motor means in the compartment causes a corresponding rotation of the drive shaft which is transmitted by the gear means to the crank shaft to cause the oscillation of the legs so that the oscillation of the legs causes the toy to be propelled in the direction of the head portion when placed in the water while water is permitted to enter the body chamber through the water inlet and to exit therefrom through the outlet to reduce the water resistance of the toy and to thereby reduce the energy consumption of the motor means.

2. A toy according to claim 1 including a foot for each leg, and means for pivotally adjustably securing the foot to an end of each leg opposite the open leg end.

3. A toy according to claim 1 wherein the arms are hollow, and including a hand for each arm, and means for adjustably attaching the hands to free ends of the arms remote from the body.

* * * * *